US005732586A

United States Patent [19]

Muessig et al.

[11] Patent Number: 5,732,586

[45] Date of Patent: *Mar. 31, 1998

[54] COLD EXTRUSION FOR HELICAL GEAR TEETH

[75] Inventors: Charles Muessig, Novi; Vijay Nagpal, Westland; Frank Nolte, Brighton; Paul Angelo Paliani, Plymouth, all of Mich.

[73] Assignee: Ford Global Technologies, Inc., Dearborn, Mich.

[ * ] Notice: The portion of the term of this patent subsequent to Jul. 18, 2014, has been disclaimed.

[21] Appl. No.: 715,756

[22] Filed: Sep. 19, 1996

[51] Int. Cl.[6] ..... B21C 23/18

[52] U.S. Cl. ..... 72/267; 72/355.4; 72/359; 29/893.34

[58] Field of Search ..... 72/264, 265, 266, 72/267, 359, 352, 353.2, 353.4, 355.4, 358, 372; 29/893.33, 893.34

[56] References Cited

U.S. PATENT DOCUMENTS

| | | | |
|---|---|---|---|
| 1,985,833 | 12/1934 | Lampart . | |
| 3,186,210 | 6/1965 | Lesher et al. . | |
| 3,267,712 | 8/1966 | Atkin . | |
| 3,605,475 | 9/1971 | Eakin et al. . | |
| 3,813,909 | 6/1974 | Roger . | |
| 3,910,091 | 10/1975 | Samanta . | |
| 4,287,749 | 9/1981 | Bachrach et al. . | |
| 4,350,865 | 9/1982 | Bachrach . | |
| 4,452,060 | 6/1984 | Kanamaru et al. . | |
| 4,546,635 | 10/1985 | Arita et al. . | |
| 4,559,803 | 12/1985 | Langford et al. . | |
| 4,614,468 | 9/1986 | Waldrich et al. . | |
| 4,622,842 | 11/1986 | Bachrach et al. . | |
| 4,770,572 | 9/1988 | Ohkawa et al. . | |
| 4,878,370 | 11/1989 | Fuhrman et al. . | |
| 4,924,690 | 5/1990 | Kanamaru et al. . | |
| 5,052,210 | 10/1991 | Hoge . | |
| 5,247,819 | 9/1993 | Morimoto et al. . | |
| 5,275,046 | 1/1994 | Nagpal et al. . | |
| 5,295,382 | 3/1994 | Fuhrman . | |
| 5,325,698 | 7/1994 | Nagpal et al. . | |
| 5,465,597 | 11/1995 | Bajraszewski et al. . | |
| 5,544,548 | 8/1996 | Iihara et al. | 29/893.34 |
| 5,551,270 | 9/1996 | Bajraszewski | 72/358 |

FOREIGN PATENT DOCUMENTS

| | | | |
|---|---|---|---|
| 25 59 239 | 7/1977 | Germany . | |
| 2848091 | 5/1980 | Germany | 72/359 |
| 3915969 A1 | 11/1990 | Germany . | |
| 60-115341 | 6/1985 | Japan | 29/893.34 |
| 61-279330 | 12/1986 | Japan | 29/893.34 |
| 62-118937 | 5/1987 | Japan | 29/893.34 |
| 63-103004 | 5/1988 | Japan | 29/893.34 |
| 4-187340 | 7/1992 | Japan . | |
| 0631373 | 2/1994 | Japan | 29/893.34 |
| 927378 | 5/1982 | Russian Federation . | |

*Primary Examiner*—Lowell A. Larson
*Assistant Examiner*—Ed Tolan
*Attorney, Agent, or Firm*—James J. Dottavio

[57] ABSTRACT

A process and apparatus for cold extruding gear teeth and projections comprises machining an annular ring gear blank with precision inside and outside diameters. The gear blank is mounted on a die ring which is arranged coaxially with respect to the blank. The die ring has internal die teeth. A mandrel having external die teeth is axially aligned with the gear blank. The mandrel or die ring is moved axially to extrude the blank through the internal and external die teeth.

23 Claims, 2 Drawing Sheets

COLD EXTRUSION FOR HELICAL GEAR TEETH

BACKGROUND OF THE INVENTION

1. Field of the Invention

The present invention relates to a method of cold forming splines and teeth on a gear.

2. Description of the Prior Art

The present invention comprises improvements in the method of cold forming internal helical gear teeth as described in U.S. Pat. No. 4,878,370 (the '370 patent), assigned to the assignee of the present invention. The '370 patent comprises a method for forming internal teeth for a ring gear by advancing an annular workpiece across external die teeth of floating mandrel that is surrounded by a die ring.

However, a gear formed by the '370 patent may also require external splines or lugs. These are formed by a secondary operation, such as turning, broaching, welding and pressing. Such secondary operations require additional labor, tooling and work in process inventory, all of which increase the cost of the gears. These secondary operations may also result in distortion of the part and may add variability to the manufacturing operations.

SUMMARY OF THE INVENTION

It is, therefore, an object of the present invention to provide a method of cold forming internal helical gear teeth and cold forming external splines or lugs in the same operation and an apparatus to perform said method.

In accordance with the above object, a process and apparatus are provided to cold extrude internal ring gear teeth and external projections. The process comprises machining an annular ring gear blank with precision inside and outside diameters. The gear blank is mounted on a die ring which is arranged coaxially with respect to the blank. The die ring has internal die teeth. A mandrel having external die teeth is axially aligned with the gear blank. The mandrel is moved axially to extrude the blank through the internal and external die teeth.

DESCRIPTION OF THE PREFERRED EMBODIMENTS

Figure 1:
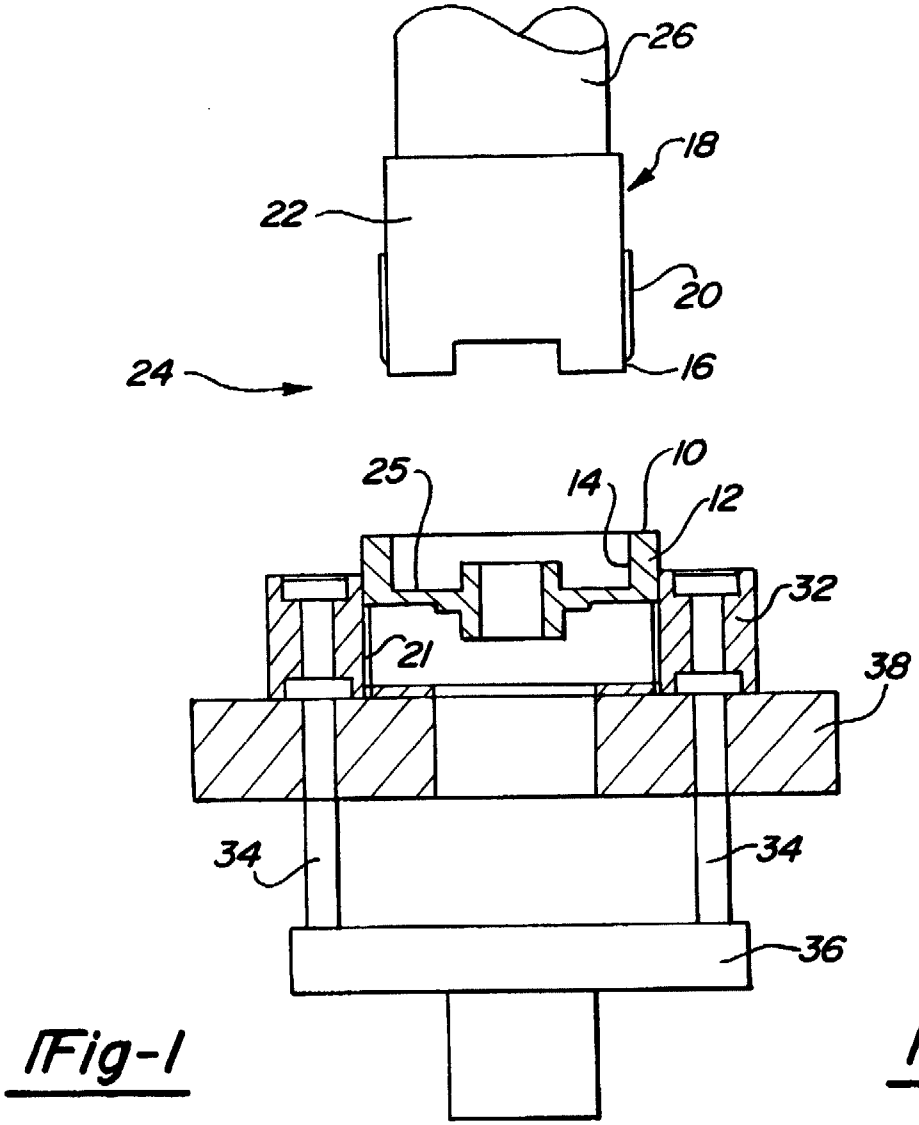
FIG. 1 is a partial sectional view showing a gear blank in an extrusion press according to the present invention.

In FIG. 1, a blank which is formed into a ring gear is designated by reference character 10. The blank 10 from which the ring gear is formed during the extrusion process is an annular ring with precision machined outside 12 and inside 14 diameters. The blank 10 is extruded between a mandrel 18 and a die ring 32, forming gear teeth and splines in a single press 24.

In a preferred embodiment, the blank 10 is positioned on a die ring 32 which is supported by a press 24. The die ring 32 rests on a die bed 38 of the press 24. A pair of rods 34 are provided to lift the die ring from the bed 38 after the blank 10 is extruded.

A mandrel 18 is supported by a ram 26 provided on the press 24. The mandrel 18 includes die teeth 20 on the outer diameter thereof. The die ring 32 includes die teeth 21 on the inside diameter of the ring 32. The die teeth on the mandrel 18 and die ring 32 form gear teeth and splines on the gear blank 10 as the blank 10 is extruded between the mandrel 18 and die ring 32.

In a preferred embodiment, the mandrel die teeth 20 form helical gear teeth on the inside diameter 14 of the blank 10 and the die teeth 21 on the die ring 32 form splines, lugs, or keyways on the outside diameter 12 of the blank 10. Alternatively, the mandrel die teeth 20 may form splines or keyways on the inside diameter 14 of the blank and the die teeth 21 on the die ring 32 may form gear teeth on the outside diameter 14 of the blank 10. One skilled in the art recognizes the gear teeth described above alternatively comprise spur gear teeth.

As the press 24 is actuated, the ram 26 forces the mandrel 18 into contact with the inside diameter 14 of the blank 10. The ram extrudes the blank through the die ring 32 forming splines on the outside diameter 12 of the blank 10. The mandrel 18 preferably rotates as the mandrel 18 is forced into the inside diameter 14 of the blank 10 by the ram 26, thereby enabling the die teeth 20 to form the helical gear teeth of a preferred embodiment. The blank 10 does not rotate relative to the die ring 32, thus the splines are formed by the axial movement of the blank 10 through the die ring 32. Alternatively, the die ring 32 is rotatably supported so the die ring 32 rotates with the blank 10 while the helical gear teeth are formed, so the relative movement of the blank 10 to the die ring 32 is axial.

To facilitate rotation of the mandrel 18, the mandrel 18 is rotatably supported by the ram 26, or the ram 26 is rotatably supported by the press 24. In a preferred embodiment, the ram is supported by a lead bar as described in U.S. Pat. No. 5,551,270 to Bajraszewski et al. and U.S. Pat. No. 5,465,597 to Bajraszewski et al., both assigned to the assignee of the present invention, which are incorporated herein in their entirety by reference. The lead bar promotes rotation of the ram 26 and mandrel 18, thereby reducing the load on the teeth 20 during formation of the gear teeth on the blank 10. Preferably, the mandrel 22 is further able to rotate relative to the lead bar in the event the rotation of the lead bar and the helical teeth are not exactly synchronized.

The lead bar described above further provides for rotation of the mandrel 18 to accommodate removal of the blank 10 after the gear teeth are formed. Thus when the ram 26 retracts, mandrel 18 rotates and the blank 10 is easily removed, or stripped, from the mandrel 18. In an alternative embodiment, the die ring 32 is rotatably supported by the press 24. In this alternative embodiment, the helical gear teeth are preferably formed on the outside diameter of the blank 10, and the blank 10 is therefore easily stripped from the mandrel 18 without requiring rotation as described above.

Figure 2:
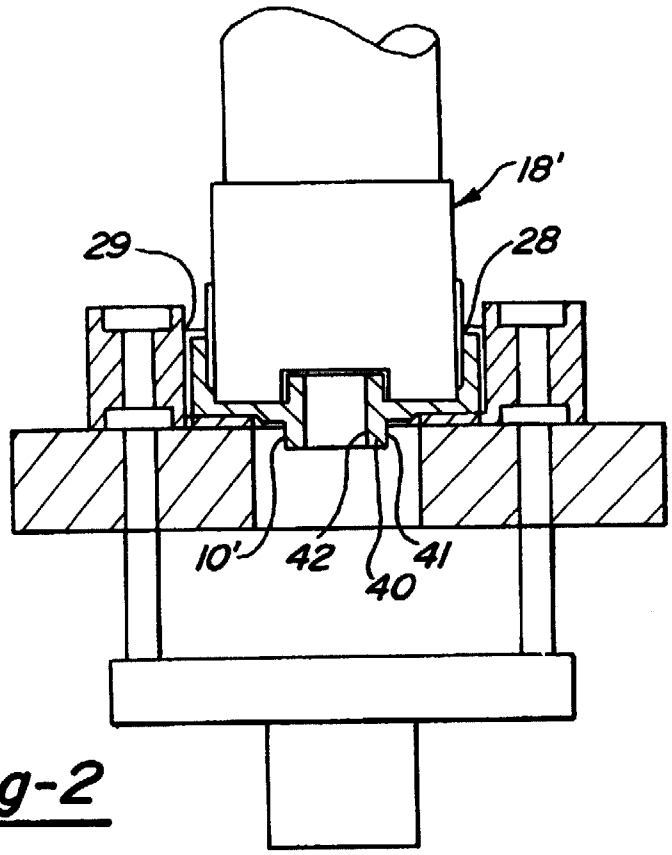
FIG. 2 is a partial sectional view of an extrusion press forming helical teeth and splines on the blank of FIG. 1.

As shown in FIG. 2, the ram 26 has extruded the blank 10 between the mandrel 18 and the die ring 32. After this extrusion is complete, the rods 34 are pushed by a cylinder 36 to raise the die ring 32 above the blank 10 which is held against the die bed 38 by the ram 26. Once the die ring 32 is above the blank 10, the ram 26 is retracted upwardly.

As the ram 26 retracts, the blank 10 contacts the bottom of the die ring 32, causing the blank 10 to be stripped from the mandrel 18. Preferably, as described above, the mandrel 18 is supported by a lead screw, which causes the mandrel 18 to rotate as the ram 26 is raised. Thus as the mandrel 18 rotates, the newly formed splines on the outside diameter of the blank become misaligned with the die teeth on the die ring 32. The interference between the splines and the die teeth results in a downward force on the blank 10 which enables the blank 10 to be stripped from the mandrel 18. Furthermore, the rotation of the mandrel 18 produced by the lead screw, as described above, enables the gear teeth on the inside of the blank 10 to be rotatably removed from the mandrel 18 as the ram 26 is raised. Otherwise, the mandrel 18 would be forced to rotate by the axial force against the helical gear teeth as the axial movement of the ram 26 causes the blank 10 to be forced against the die ring 32 as described above. This axial force for retraction without rotation would therefore be much greater than that required using the lead screw as described above to rotate the mandrel 18.

After the ram 26 is raised, the blank 10 drops below the die ring 32 and a formed gear is completed. The gear is removed from under the die ring 32 in a known manner as taught in the '370 patent. The cylinder 36 which raised the die ring 32 is then retracted so the die ring 32 rests against the die bed 38 and a second blank 10 is positioned on the die ring 32 as shown in FIG. 1 to repeat the cycle and form a second gear.

In a further alternative embodiment (not shown), the ram supports the die ring and the die bed supports the mandrel. In this embodiment, a blank is loaded on the mandrel and the ram forces the die ring over the blank. In this embodiment, the die ring may form either external splines or external gear teeth as described above. The mandrel forms internal gear teeth or splines as further described above. When helical gear teeth are formed, either the die ring or mandrel rotate. If external helical teeth are formed, it is preferable the die ring rotates using a lead screw as described above. If internal helical gear teeth are formed, it is preferable the mandrel rotates. Therefore the gear is more easily stripped after the teeth are formed. U.S. Pat. No. 4,878,370 (the '370 patent), assigned to the assignee of the present invention, which is incorporated herein by reference describes one means by which the mandrel is rotatably supported by the press.

A pilot portion 16 of the mandrel 18 fits into the inner 14 diameter of the blank 10. The mandrel 18 is a cylindrical member on which are formed external die teeth 20. In a preferred embodiment, the shape of the die teeth 20 is described in the '370 patent. The mandrel 18 includes a support portion 22 which is adapted to be fitted to the press 24. When the press 24 is stroked, the mandrel 18 forces the blank 10 into a die ring 32 as described above.

In a further alternative embodiment (not shown), the mandrel is rotatably supported by the press bed. In this alternative embodiment, the die ring is also supported by the press bed. A punch having an annular end adjacent the blank with radial dimensions equal to the radial dimensions of the blank, as described in the '370 patent, advances the blank between the die ring and mandrel. In this embodiment, the mandrel rotates relative to the die ring and blank to form the helical teeth on the blank while the blank is extruded between the mandrel and die ring by the punch. In this embodiment, as described in the '370 patent, when a ring gear is formed, a second blank may be inserted into the die or over the mandrel in end-to-end juxtaposed relationship, so the punch advances the blanks through the die teeth until it is ejected at the lower portion of the press.

In a further alternative embodiment, the gear 10' shown in FIG. 2 has additional features, such as gear teeth or splines (not shown) formed on the hub 40 portion of the gear 10'. A second mandrel (not shown) or die ring (not shown) is supported by the base 38 or cylinder 36 to form the additional splines or gear teeth on the outside 41 or inside 42 surface of the hub 40. Thus, while the first mandrel 18 forms the internal gear teeth 28, the second mandrel forms the further teeth or splines 41, 42. The second mandrel or die ring rotates relative to the blank 10' to form the second pair of helical teeth thereon, or the blank 10' is extruded nonrotatably relative to the additional mandrel or die ring to form additional splines.

The figures illustrate a blind hole 14 terminating at a flange 25 provided in the blank 10 on which the helical gear teeth are formed. However, one skilled in the art recognizes the blank 10 may be a blank for a ring gear, where hole 14 is a through hole, as illustrated in the '370 patent. When a ring gear is formed, the process may be easily automated to unload the gears 10' as described in the '370 patent. The process to form the gear having a blind hole 14 shown in FIGS. 1–4 may also be automated, but the automation requires the gear 10' to be stripped from the mandrel 18 as described above.

Figure 4:
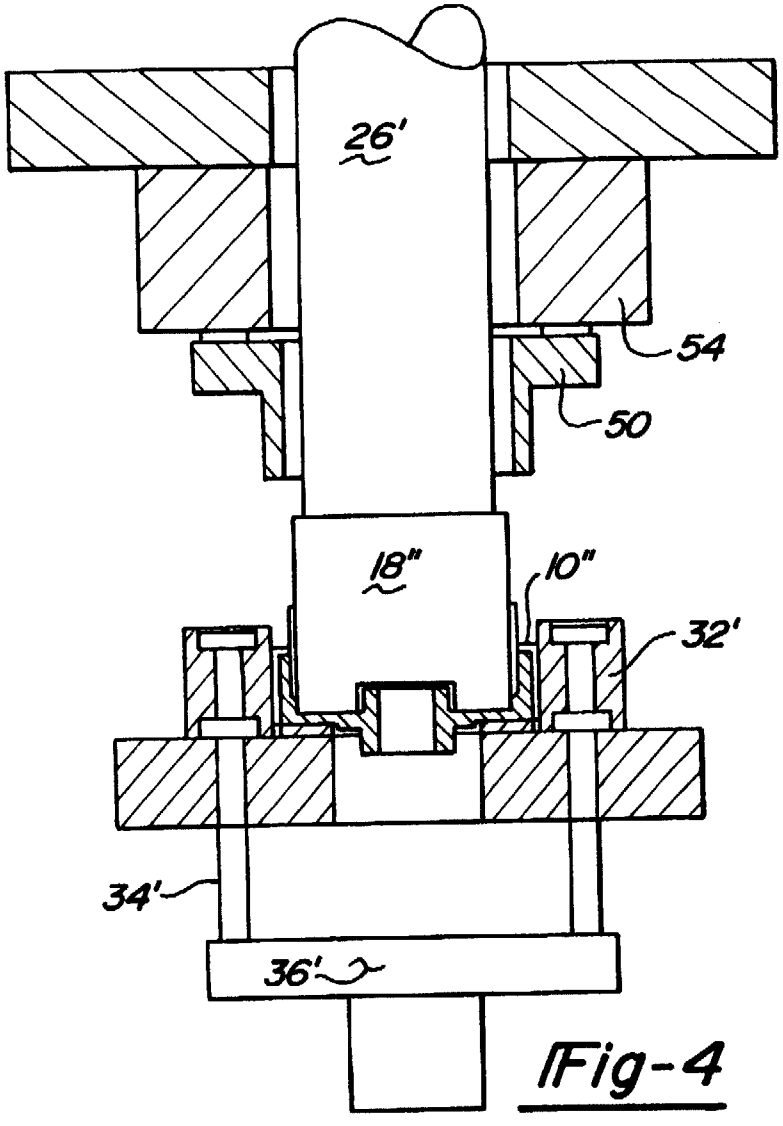
FIG. 4 is a partial sectional view of an extrusion press forming helical teeth and splines on the blank of FIG. 3.
Figure 3:
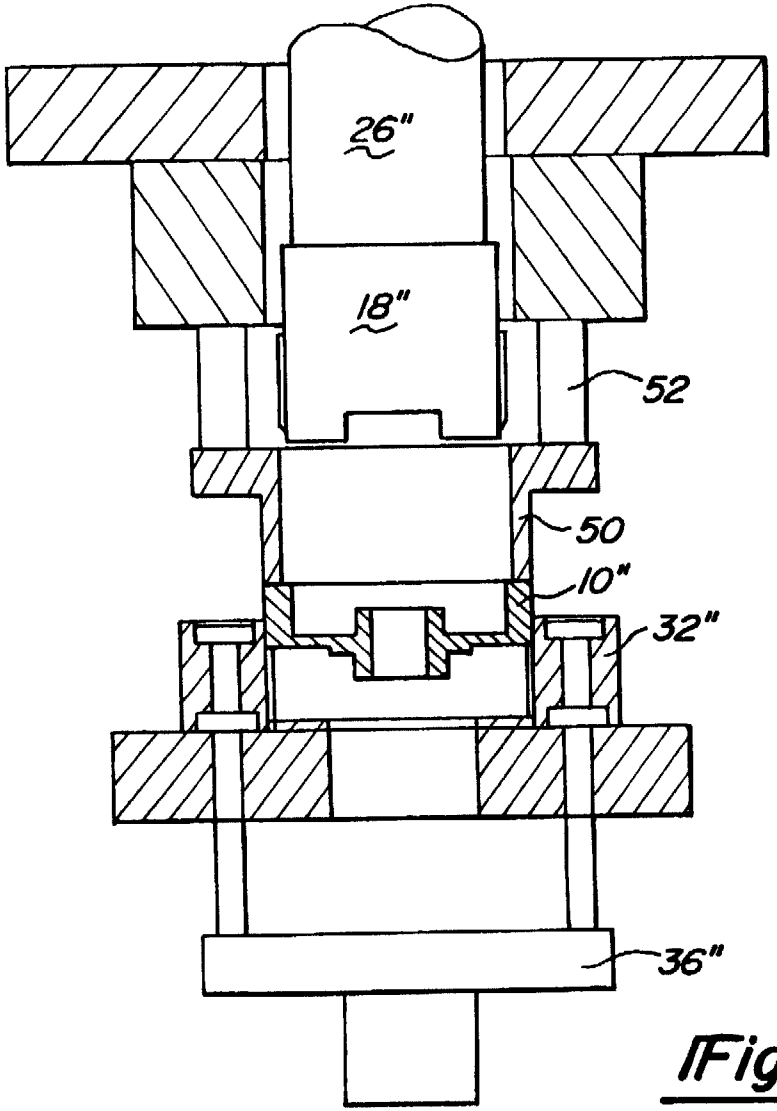
FIG. 3 is a partial sectional view showing an alternate press according to the present invention.

FIGS. 3 and 4, show an alternative embodiment to the single stage process described in FIGS. 1 and 2. In FIGS. 3 and 4, a two-step extrusion process is provided in a single press 24". In this two-step process, an annular punch 50 forces the blank 10" into a die ring 32" to form splines on the outer diameter of the blank 10". The die ring 32" includes internal projections to form the splines on the outer diameter of the blank 10" as described above. The punch 50 is advanced by a first cylinder 52 into contact with the blank 10" to extrude the blank 10" in the die ring 32". As shown in FIG. 4, the punch 50 is withdrawn toward a carrier 54 and a second cylinder advances a second ram 26" which carries the mandrel 18" to form the gear teeth in the blank 10" as described above.

Alternatively, both the second punch 50 and first punch 26" described above and illustrated in FIGS. 3 and 4 are advanced by a single cylinder, wherein the cylinder advances the second punch 50 to extrude the blank 10" through the die ring 32" to form the outer splines. The ram 26" is advanced thereafter to force the mandrel 18" into the blank 10" to form the gear teeth. The second punch 50 partially extrudes the blank through the die ring 32". At this point, spring loaded rods 52, which hold the second punch 50, are compressed when the mandrel 18" engages the blank 10". The mandrel 18" is advanced by the cylinder, thereby forming the internal helical gear teeth as described above and in the '370 patent. The gear is then extruded completely through the die ring 32" by the mandrel 18", or by the second punch 50, or by a second blank which is loaded into the die ring 32" adjacent the first blank 10" as described in the '370 patent.

In a further alternative embodiment, a two stage press operation may be performed as described above with reference to FIGS. 3 and 4, but in this embodiment, the die ring 32" is supported by the ram 26 and a mandrel 18" is supported by a jig 36". Thus, a second punch 50 advances to extrude the blank 10" over the mandrel 18" supported by the press 24". Then the die ring 32" is advanced and forms the splines on the blank 10".

A further alternative embodiment for the two stage process described above with reference to FIGS. 3 and 4 includes a mandrel 18" and the die ring 32" being supported by the die bed 38", in a manner similar that shown in the '370 patent. The second punch 50 advances the blank 10" through the die ring 32". A second die ring (not shown) is supported by the ram 26" and is advanced by the ram 26" to extrude the blank 10" over the mandrel 18" to form the internal gear teeth as described above.

As shown in U.S. Pat. No. 5,275,046, assigned to the assignee of the present invention, which is incorporated herein by reference, the present invention may be applied to forming external helical gear teeth, although not shown here. The present invention further provides for forming internal splines in the same operation as the external helical gear teeth, using a method similar to that described above for the internal teeth and external splines. U.S. Pat. No. 5,551,270 describes in further detail the apparatus and method used to form the internal helical gear teeth as described above.

It is understood that while the form of the invention herein shown and described constitutes the preferred embodiments of the invention, it is not intended to illustrate all possible forms thereof. It will also be understood that the words used are words of description rather than limitation, and that various changes may be made without departing from the spirit and scope of the invention as disclosed.

We claim:

1. A process for cold extruding gear teeth and projections comprising the steps of:

machining an annular ring gear blank with precision inside and outside diameters;

mounting said gear blank on a die ring arranged coaxially with respect to said blank, said die ring having internal die teeth;

axially aligning a mandrel with said gear blank, said mandrel having external die teeth; and moving one of the group consisting of said die ring and said mandrel axially whereby said blank is extruded partially through said internal and external die teeth.

2. The combination set forth in claim 1, wherein said die ring is rotatably supported on a die bed in a press whereby the extruding motion of said blank is accompanied by rotary movement of said die ring to accommodate any lead angle for helical teeth for the gear.

3. The combination set forth in claim 1, wherein said mandrel is rotatably supported by a ram on a press whereby the extruding motion of said blank is accompanied by rotary movement of said mandrel to accommodate any lead angle for helical teeth for the gear.

4. The combination set forth in claim 3, wherein said ram is rotatably supported by said press.

5. The combination set forth in claim 4, wherein the gear teeth comprise internal gear teeth and the projections comprise external axial splines.

6. The combination set forth in claim 5, wherein the blank is extruded through the die ring and the blank is stripped from the mandrel as the mandrel is rotated and retracted axially.

7. A process for cold extruding gear teeth and projections comprising the steps of:

machining an annular ring gear blank with precision inside and outside diameters;

mounting said gear blank on a mandrel, said mandrel having external die teeth;

axially aligning a die ring coaxially with respect to said blank over said blank, said die ring having internal die teeth; and axially moving one of the group consisting of the mandrel and die ring to press said blank to extrude said blank through said internal and external die teeth.

8. The combination set forth in claim 7, wherein said mandrel is rotatably supported by a die bed whereby the extruding motion of said blank is accompanied by rotary movement of said mandrel to accommodate any lead angle for helical teeth for the ring gear.

9. The combination set forth in claim 8, wherein said die ring moves axially to extrude said blank between said die ring and said mandrel.

10. The combination set forth in claim 8, wherein a punch having an annular end is provided adjacent the blank, said punch being moved axially to press the blank between the die ring and the mandrel.

11. A process for cold extruding gear teeth and projections comprising the steps of:

machining an annular ring gear blank with precision inside and outside diameters;

mounting said gear blank in a die ring, said die ring being arranged coaxially with respect to said blank, said die ring further having internal die teeth;

axially aligning a mandrel to said gear blank, said mandrel having external die teeth;

axially aligning a punch around said mandrel adjacent said blank;

axially moving said punch to extrude said blank through said first die ring; and axially moving said mandrel to extrude said blank through said external die teeth.

12. The combination set forth in claim 11, wherein said die ring is rotatably supported by a die bed in a press whereby the extruding motion of said blank is accompanied by rotary movement of said die ring and said blank to accommodate any lead angle for helical teeth for the gear and said gear comprises a ring gear.

13. The combination set forth in claim 11, wherein said mandrel is rotatably supported by said press whereby the extruding motion of said mandrel is accompanied by rotary movement of said mandrel to accommodate any lead angle for helical teeth for the gear.

14. The combination set forth in claim 13, wherein said punch is advanced by a first cylinder and said mandrel is advanced by a second cylinder.

15. An apparatus for cold extruding teeth and projections on a gear blank comprising:

a press;

a die ring supported by said press, said die ring having internal projections and arranged coaxially with said blank; and a mandrel supported by said press, said mandrel having external die teeth, wherein one of the group consisting of said die ring and said mandrel is moved axially to extrude said blank between said internal projections and said external die teeth.

16. An apparatus for cold extruding teeth and projections on a gear blank comprising:

a press;

a die ring supported by said press, said die ring having internal projections and arranged coaxially with said blank;

a mandrel supported by said press, said mandrel having external die teeth, wherein one of the group consisting of the mandrel and die ring is rotatably supported by the press in order to form internal or external helical gear teeth when said blank is extruded between said mandrel and said die ring.

17. The combination set forth in claim 16, wherein said internal projections on said die ring form external splines on said blank and said external die teeth on said mandrel form internal helical gear teeth on said blank.

18. The combination set forth in claim 17, wherein said mandrel is rotatably supported by said press whereby the extruding motion of said blank is accompanied by rotary movement of said mandrel to accommodate any lead angle for helical teeth for the ring gear.

19. The combination set forth in claim 16, wherein said internal projections on said die ring form external gear teeth on said blank and said external die teeth on said mandrel form internal splines on said blank.

20. The combination set forth in claim 19, wherein said die ring is rotatably supported by a die bed on a press whereby the extruding motion of said blank is accompanied by rotary movement of said die ring to accommodate any lead angle for helical teeth for the ring gear.

21. An apparatus for cold extruding teeth and projections on a gear blank comprising:

a press;

a die ring supported by said press, said die ring having internal projections and arranged coaxially with said blank;

a mandrel supported by said press, said mandrel having external die teeth, wherein said blank is extruded between said mandrel and said die ring; and a punch supported by said press, said punch being arranged around said mandrel adjacent said blank, wherein said punch is moved axially to extrude said blank through said first die ring and one of the group consisting of said die ring and said mandrel is moved axially to extrude said die ring between said internal projections and said external die teeth.

22. The combination set forth in claim 21, wherein said internal projections on said die ring form external splines on said blank and said external die teeth on said mandrel form helical gear teeth on said blank.

23. The combination set forth in claim 21, wherein said internal projections on said die ring form external helical gear teeth on said blank and said external die teeth on said mandrel form internal splines on said blank.

* * * * *